US009809345B2

(12) United States Patent
Harrison et al.

(10) Patent No.: US 9,809,345 B2
(45) Date of Patent: Nov. 7, 2017

(54) PAPERBOARD PACKAGE

(71) Applicant: Tekton, Inc., Grand Rapids, MI (US)

(72) Inventors: Joshua L. Harrison, Grand Rapids, MI (US); Matthew A. Johnson, South Haven, MI (US)

(73) Assignee: Tekton, Inc., Grand Rapids, MI (US)

( * ) Notice: Subject to any disclaimer, the term of this patent is extended or adjusted under 35 U.S.C. 154(b) by 367 days.

(21) Appl. No.: 14/801,891

(22) Filed: Jul. 17, 2015

(65) Prior Publication Data

US 2017/0015460 A1 Jan. 19, 2017

(51) Int. Cl.

| | |
|---|---|
| ***B65D 85/28*** | (2006.01) |
| ***B65D 5/00*** | (2006.01) |
| ***B65D 5/04*** | (2006.01) |
| ***B65D 5/42*** | (2006.01) |
| ***A47G 29/087*** | (2006.01) |

(52) U.S. Cl.

CPC ..... *B65D 5/009* (2013.01); *A47G 29/087* (2013.01); *B65D 5/04* (2013.01); *B65D 5/4208* (2013.01)

(58) Field of Classification Search

CPC ..... B65D 5/009; B65D 5/04; B65D 5/4208; B65D 5/5021; B65D 5/504; A47G 29/087

USPC ..... 206/349, 372, 377, 379, 485, 806; 211/70.6; 229/117.12, 117.18, 128

See application file for complete search history.

(56) References Cited

U.S. PATENT DOCUMENTS 1,783,453 A * 12/1930 Reisert ..... B65D 5/4204 206/485
3,405,860 A * 10/1968 Manizza ..... B65D 5/5021 206/485
3,812,957 A * 5/1974 Forbes, Jr. ..... B65D 5/02 206/485
4,450,965 A * 5/1984 Paillet ..... B65D 5/504 206/485
5,346,063 A * 9/1994 Chow ..... B25H 3/04 206/485
5,505,309 A * 4/1996 Taravella ..... B65D 5/5021 206/485
5,597,070 A * 1/1997 Wu ..... B65D 5/504 206/485
5,829,587 A * 11/1998 Saiki ..... B65D 5/4208 206/485
7,624,876 B1 * 12/2009 Green ..... B65D 5/5021 206/485

* cited by examiner

*Primary Examiner* — Luan K Bui

(74) *Attorney, Agent, or Firm* — Warner Norcross & Judd LLP

(57) ABSTRACT

A point-of-sale paperboard package having spaced-apart support rails that support packaged article(s), and a top closure affixed to the support rails by packaged article(s). The top closure may include retaining flaps secured to the support rails by packaged article(s) extending through the support rails and the retaining flaps. The top closure may include a hanging tab allowing the package to be suspended from a hanging hook at a point of sale. The support rails and top closure may be defined by consecutive panels folded into a rectangular shape. The top closure may be folded into the space between the support rails to prevent the support rails from unfolding. The retaining flaps may extend from the top closure into the hollow interior of the support rails. The support rails and retaining flaps may define article receiving openings to facilitate insertion of packaged articles. The package may include a bottom closure.

27 Claims, 10 Drawing Sheets

PAPERBOARD PACKAGE

BACKGROUND OF THE INVENTION

The present invention relates to packaging and, more particularly, to point-of-sale paperboard packaging.

Paperboard packaging is well known in the packaging art. A typical paperboard package is constructed from pre-cut sheets of paperboard (often called "blanks"). A conventional blank is a single, continuous sheet of paperboard having a shape dictated by the number and arrangement of panels included in the package. The blanks are often pre-scored or otherwise configured to define fold lines that facilitate folding of the blank into the desired shape. The blank will typically include one or more retaining flaps that can be used to permanently secure the blank in the folded configuration or to temporarily secure a closure, such as a lid, in the closed position. For example, a conventional paperboard package may include a retaining flap that is attached to another panel by adhesive or fasteners (e.g. staples) to permanently secure the blank in the shape of the package. The use of adhesives and/or fasteners has a number of drawbacks. For example, adhesives and fasteners increase cost and complicate the manufacturing process. Costs are increased not only by the cost of the adhesive and the fasteners, but also by the cost of the equipment required to apply the adhesive or install the fasteners. Additionally, the use of adhesive can have a significant negative impact on the environment. For example, many adhesives utilize solvents and other potentially toxic components. Also, the presence of adhesives can complicate efforts to recycle the paperboard package. Further, the integrity of an adhesive bond can be impacted by delamination of the paperboard, and the strength of a staple bond can be limited by the tear-strength of the paperboard. As a result, in applications where the attachment is required to bear a significant amount of weight, it may be necessary to use more expensive paperboard with greater delamination strength and/or greater tear strength.

In addition to permanent attachments, retaining flaps are also used with temporary attachments. For example, it is often desirable to provide a package with a lid that can be repeatedly opened and closed to selectively provide access to the contents of the package. To provide this functionality, the package may include a top closure with a retaining flap that can be fitted into the package to temporarily hold the top closure in the closed configuration. In this context, the retaining flap may have small slits that interlock with internal flaps that help to hold the top closure in the closed position. These types of temporary joints have limited hold strength and, if used without supplementation, typically prevent the package from being suspended by a hanging tab secured to the top closure because the weight of the package can pull open the top closure. This is a particularly significant drawback in the context of point-of-sale packaging where it is often desirable to suspend packages from a hanging hook.

SUMMARY OF THE INVENTION

The present invention provides a point-of-sale paperboard package having a pair of spaced-apart support rails that receive and support one or more packaged articles and a top closure that is secured to the support rails by one or more packaged articles. The top closure may include a pair of retaining flaps that extend adjacent to the support rails and intersect with one or more of the packaged articles. In one embodiment, each retaining flap extends into one of the support rails and is secured to that support rail by a packaged article that extends through the support rail and the retaining flap.

In one embodiment, the product support rails are defined by a series of consecutive panels folded into a tube-like configuration. For example, the product support rails may include a series of panels that are folded into a rectilinear configuration. The panels may be folded to into a rectangular shape, a triangular shape or another hollow shape with a different number of sides. The retaining flaps may extend into the hollow interior of the product support rails. The retaining flaps may define one or more product receiving opening configured to allow the packaged articles to be inserted through the retaining flaps.

In one embodiment, the top closure includes an inner panel that is folded into the space between the support rails. The inner panel may be closely fitted into the space to prevent the support rails from unfolding. The inner panel may include tabs that interlock with corresponding slots in the support rails to hold the inner panel in the folded position between the support rails.

In one embodiment, the package includes a bottom closure with a pair of retaining flaps. The bottom closure is folded into position and secured in the folded position by the retaining flaps, which intersect with one or more of the packaged articles. In one embodiment, a packaged article extends through at least one support rail and at least one retaining flap of the bottom closure.

In one embodiment, the product support rails are held in the folded configuration by the top and bottom closures. For example, in one embodiment, the product support rails include inner panels that are spaced apart from one to define an intermediate rectangular space, and the top and bottom closures each include a rectangular inner panel that is closely fitted into the intermediate rectangular space between the support rails.

In one embodiment, the package includes left and right support rails extending along the left and right edges of the package. The left support rail may include an outer panel, an intermediate panel and an inner panel. The outer panel may be joined to the main panel along a fold line or a score line. The intermediate panel may be joined to the outer panel along a fold line or a score line. The inner panel may be joined to the intermediate panel along a fold line or a score line. The fold line may be defined by essentially any feature intended to facilitate folding along a desired line, such as a score line, a crease line, a cut line or a plurality of spaced-apart cuts or perforations.

In one embodiment, the outer panel of a support rail defines one or more openings configured to receive the article or articles to be packaged. For example, in the context of a package configured to support a set of eight screwdrivers, the outer panel of the left support rail may define four openings that are configured to allow the quillon of the screwdriver handle to be inserted through the outer panel into the product support rail. In this embodiment, the inner panel may have an opening that allows passage of the screwdriver shaft, but not the quillon. As a result, in this embodiment, the quillon can be firmly seated in the hollow interior of the support rail.

In one embodiment, the top closure includes an outer panel, an intermediate panel and an inner panel that are folded to form an end rail extending from the main panel. The inner panel may be fitted into the space between the right support rail and the left support rail and include end tabs that are inserted into corresponding slots in the right support rail and the left support rail. The outer panel also includes a pair of retaining flaps that extend into the hollow interior of the support rails where they are intersected by packaged articles passing through the support rails.

In one embodiment, the package may include a central beam that provides supplemental support for packaged articles. The central beam may be disposed in the space between the left and right support rails where it can be intersected by packaged articles. The support beam may be formed by additional panels that extend from the inner panels of the left and right support rails. The top and bottom closures may include slots that are fitted over opposite ends of the central beam. Although centered in the illustrated embodiment, the beam may be disposed off-center, if desired.

The present invention provides a simple and effective package that is easily and inexpensively manufactured and assembled without the need for adhesives or fasteners to secure the retaining flaps. As a result, the package can be completely biodegradable and recyclable, and is therefore environmentally friendly. Given that adhesives and fasteners are unnecessary, the package can be manufactured and assembled without the need for complex and expensive adhesive applicators, tape applicators or fastener installation equipment. The package is also durable allowing the packaged articles, rather than adhesives, tapes or fasteners, to intersecure the closures and the support rails. This can be particularly beneficial in packages that are hung from a display hook as the weight of the packaged articles is borne predominantly by that interconnection. The package allows articles to be easily arranged in a staggered configuration that reduces the footprint and overall size of the package.

The package is particularly well suited for use in packaging a set of screwdrivers. The package allows the quillon to be firmly seated in one support rail with the screwdriver shaft extending across the package through the opposite support rail. If desired, the handle, a majority of the shaft and the screwdriver tip can be made accessible to the consumer. The package can support screwdrivers of different sizes and with different length shafts. For example, the same package can hold stubby screwdrivers as well as full-length screwdrivers. If desired, screwdrivers may be fitted into the package from opposite sides and may be arranged in staggered rows to improve fill and reduce package size. The width and length of the package can be varied to allow packaging of a different types and different numbers of screwdrivers. If desired, a central beam can be incorporated into the package to accommodate an even wider range of articles, such as screwdrivers with a wide range of shaft lengths.

These and other objects, advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

A. Overview

Figure 1A:
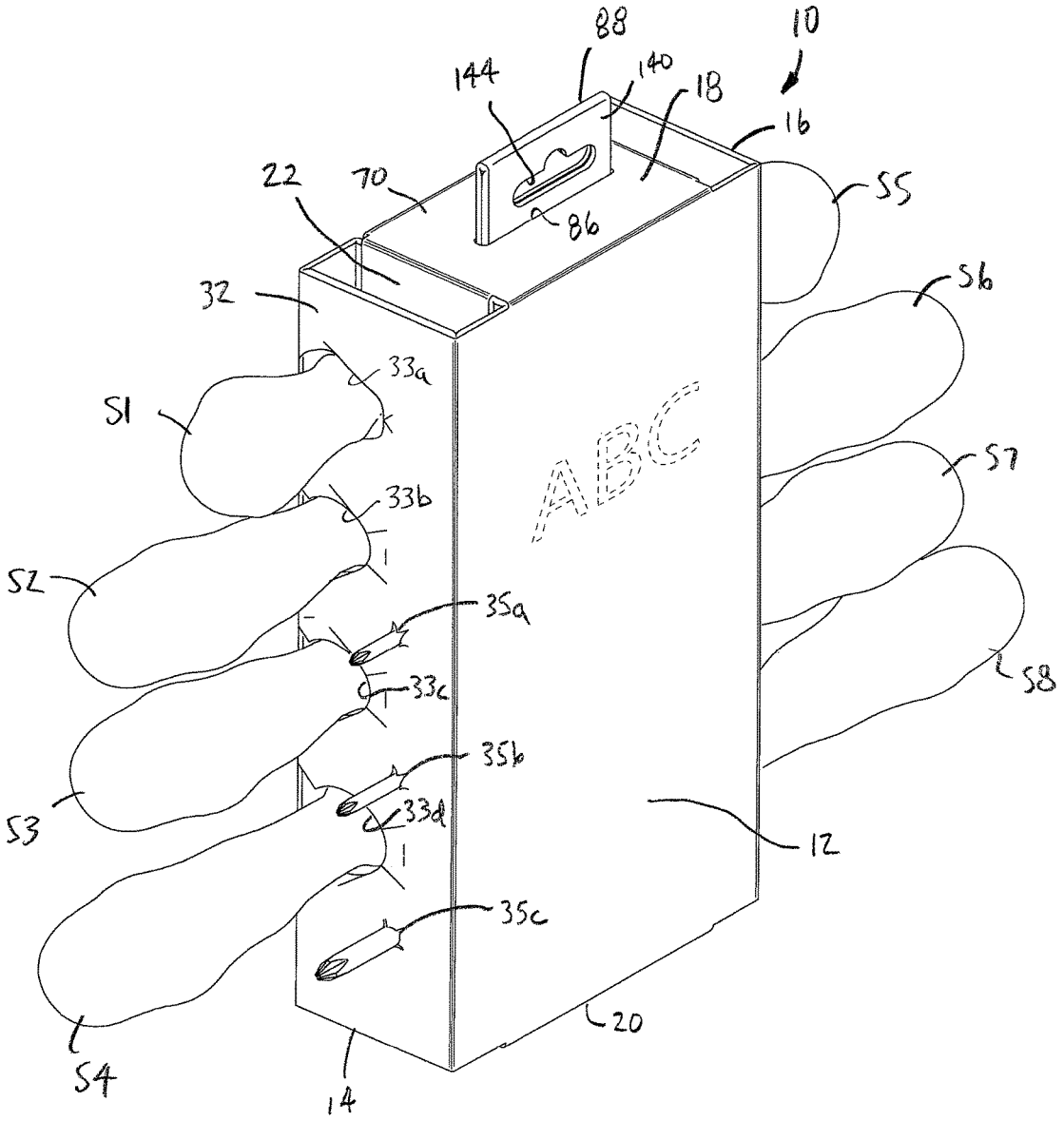
FIG. 1A is a front perspective view of a package in accordance with an embodiment of the present invention.
Figure 1B:
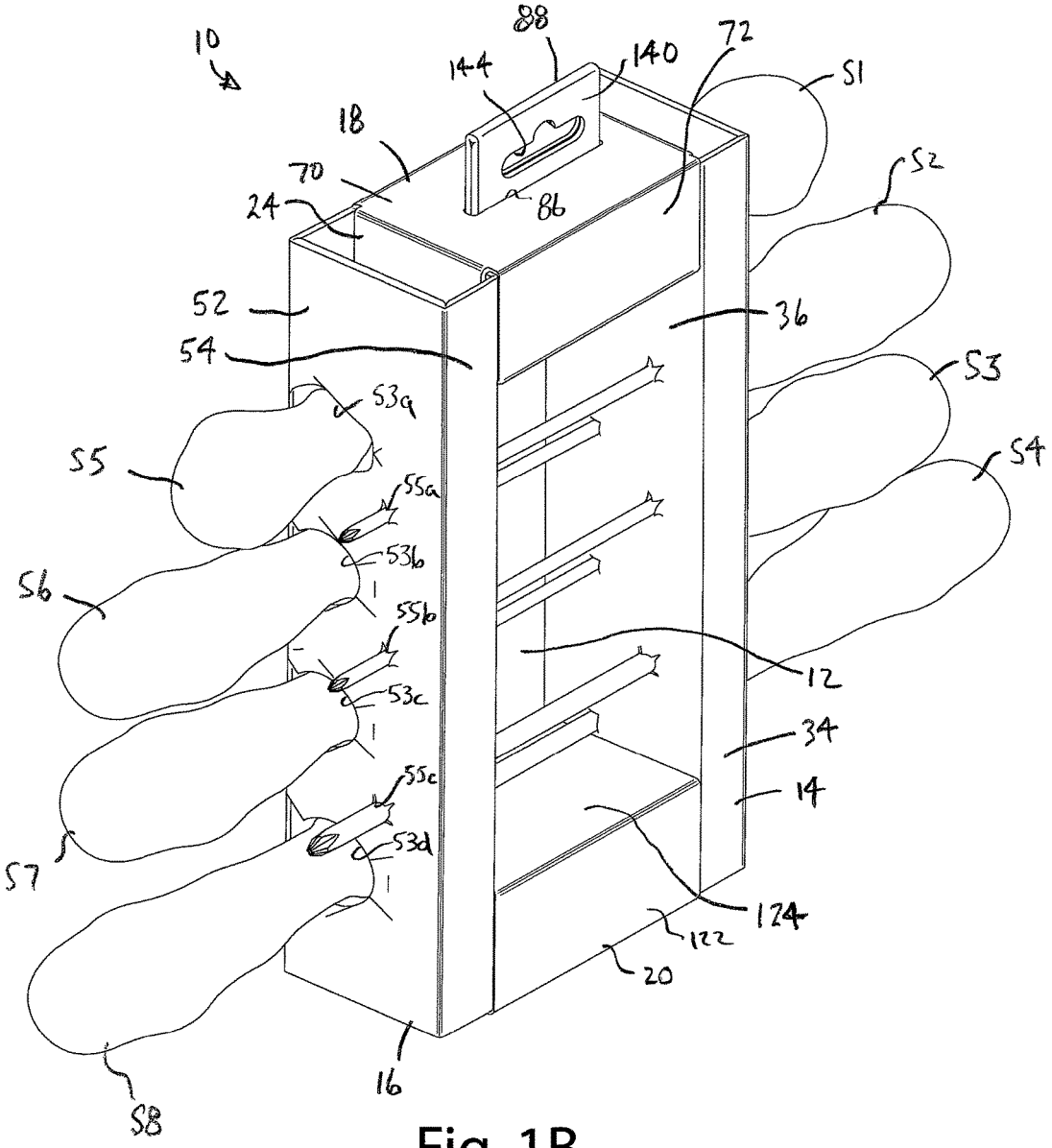
FIG. 1B is a back perspective view of a package in accordance with an embodiment of the present invention.
Figure 2:
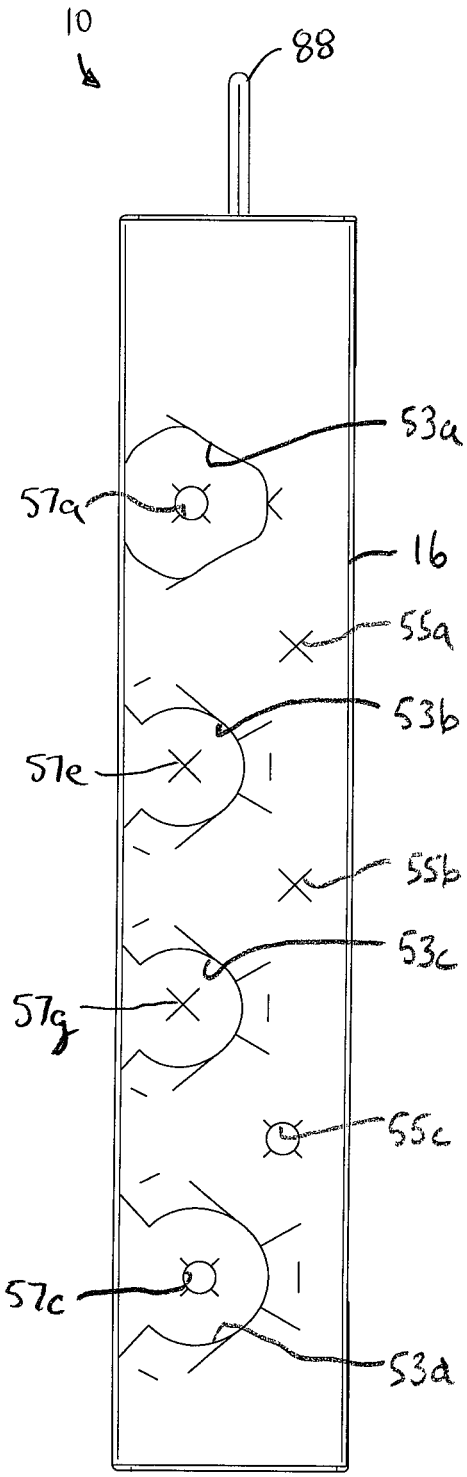
FIG. 2 is a left side view of the package with the screwdrivers removed to better show the underlying openings.
Figure 3:
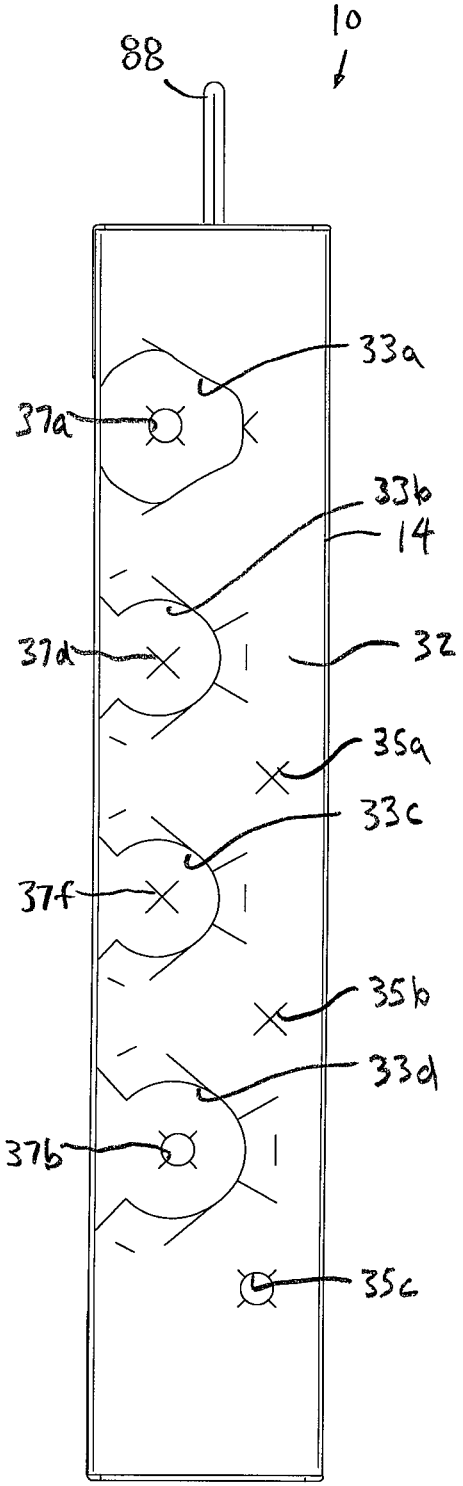
FIG. 3 is a right side view of the package with the screwdrivers removed to better show the underlying openings.
Figure 4:
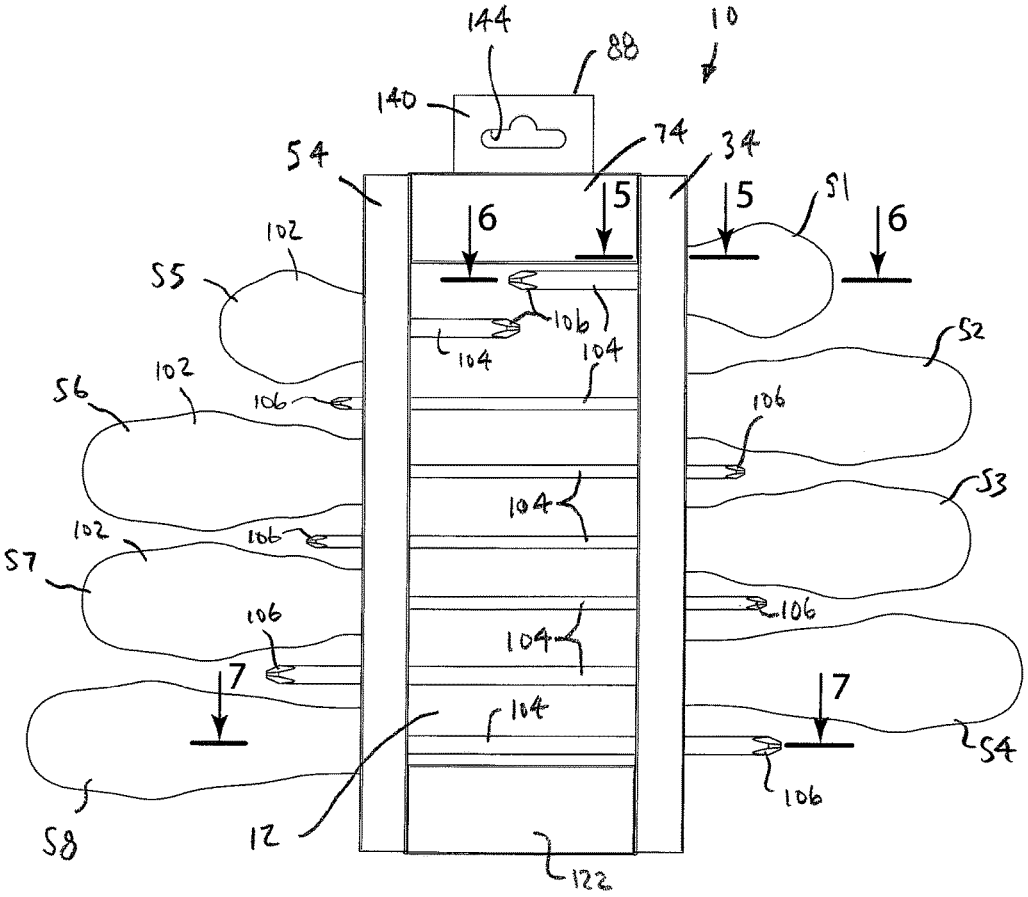
FIG. 4 is a rear plan view of the package.

A paperboard package 10 in accordance with an embodiment of the present invention is shown in FIGS. 1A and 1B. In this embodiment, the paperboard package 10 is intended for use in packaging a set of eight screwdrivers S1-S8. The package 10 is intended for use as a point-of-sale package that can be suspended at the point of sale from a display hook. The illustrated package 10 is manufactured from a paperboard blank 30 (See FIG. 8) having a plurality of panels that are folded to form the finished package 10. The package 10 of this embodiment generally includes a main panel 12, a left support rail 14, a right support rail 16, a top closure 18, a bottom closure 20 and a hanging tab 88. The main panel 12 of this embodiment is generally rectangular and forms the back of the package 10. In this embodiment, the left support rail 14, right support rail 16, top closure 18 and bottom closure 20 extend from the edges of the main panel 12, and each one of them is formed by a series of consecutive panels that are folded generally inward into a rectangular configuration. The top closure 18 includes a pair of retaining flaps 22 and 24 that extend into the left support rail 14 and right support rail 16. Similarly, the bottom closure 20 includes a pair of retaining flaps 26 and 28 that extend into the left support rail 14 and right support rail 16. The retaining flaps 22, 24, 26 and 28 extend into the support rails 14 and 16 a sufficient distance to intersect with one or more packaged article S1-S8. Intersection with packaged articles interconnects the retaining flaps 22, 24, 26 and 28 and the support rails 14 and 16, thereby securing the top and bottom closures 18 and 20. This not only secures the package 10 in the folded configuration, but also provides a strong interconnection between the top closure 18 and the support rails 14 and 16, which allows the package 10 to be hung at the point of sale from the hanging tab 88 despite the significant weight of the packaged screwdrivers.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

B. Package

Package 10 will now be described in more detail with reference to FIGS. 1-9. In this embodiment, the paperboard package is configured for use as a point-of-sale package to hold a set of eight screwdrivers S1-S8 (See FIGS. 1A and 1B). It should be understood that the package can be readily adapted for use in packaging a different number or arrangement of screwdrivers or in packaging altogether different articles. In this configuration, the package securely holds a set of eight screwdrivers—four screwdrivers extending from left to right and four screwdrivers extending from right to left. The screwdrivers S1-S8 are held by entrapping the quillon 100 in either the left or right support rail 14 or 16, while the remainder of the handle 102, a significant portion of the shaft 104 of the screwdriver and the tip 106 of the screwdriver are exposed. This allows a consumer to visually and physically inspect a majority of the screwdrivers S1-S8 while they remain in the package 10. With stubby screwdrivers S1 and S5, the shaft 104 terminates in the space between the support rails 14 and 16. With full-length screwdrivers S2-4 and S6-8, the shaft 104 extend through both support rails 14 and 16, thereby positioning the tip 106 outside of the package 10. This arrangement may be varied from application to application. For example, in applications where it may be desirable to conceal the tip of a screwdriver, the spacing between the left and right support rails may be adjusted so that the screwdriver shaft terminates within a support rail. The characteristics of the package 10 may be varied to control the amount of force required to insert and remove screwdrivers S1-S8. More specifically, interaction between the quillon 100 and the package 10 may be controlled by varying the configuration of the quillon openings. For example, the size, shape and configuration of the holes and/or retaining flaps arranged about the holes may be varied to control the amount of force required to remove a screwdriver S1-S8 from the package 10. These characteristics may be adjusted to allow screwdrivers to be repeatedly inserted and removed without damaging the package, which may facilitate use of the package by the consumer for storing the screwdrivers S1-S8 after purchase. Alternatively, these characteristics may be set so that it is difficult to remove a screwdriver S1-S8 from the package 10 without damaging the package 10. This may help to improve security at the point-of-sale. Although described in the context of a point-of-sale package, the present invention may be adapted for use in alternative applications. For example, the present invention is not limited to use at the point of sale, but may instead be incorporated into an organizer or a storage device that can be used by a consumer to hold or store objects. In this context, the package may be manufactured from more durable materials that are capable of withstanding repeated insertion and removal of article from the package.

As noted above, the package 10 generally includes a main panel 12, a left support rail 14, a right support rail 16, a top closure 18, a bottom closure 20 and a hanging tab 88. Depending on the application, either major surface of the main panel 12 may form the front surface of the package 10. For example, the major surface of the main panel 12 facing the screwdrivers may be the front surface of the package 10 in applications where it is desirable for the packaged articles to face forward. As an alternative example, the major surface of the main panel 12 facing away from the screwdrivers may be the front surface of the package 10 in applications where it is desirable to have a larger front surface capable of bearing graphics and other printed material. In the illustrated embodiment, the main panel 12 is generally rectangular, but its shape may vary from application to application, as discussed below in more detail. For example, the number and relative length of the sides of the main panel 12 may vary from application to application.

Referring now to FIGS. 4-7, the left support rail 14 and right support rail 16 receive and support the packaged articles. Some articles may be supported by a single rail, while other articles may be supported by both rails. For example, screwdriver S1 is fitted into the left support rail 14, screwdriver S5 is fitted into the right support rail 16 and screwdrivers S2-S4 and S6-S8 are fitted through both the left support rail 14 and the right support rail 16. In the illustrated embodiment, the left support rail 14 extends along the left side of the package 10 and is formed by a series of consecutive panels that extend from the main panel 12 and are folded inwardly to form a hollow rail structure. In the illustrated embodiment, the left support rail 14 is generally rectilinear, including a series of planar panels. More specifically, in this embodiment, the left support rail 14 includes a series of three consecutive panels that are folded into a rectangular configuration, thereby defining a hollow rectangular central region. In this embodiment, a portion of the main panel 12 forms the fourth side of the rectangular configuration. The left support rail 14 may be formed by a different number of panels. For example, the left support rail 14 may alternatively be formed by two consecutive panels that extend from the main panel 12 and are folded into a rectangular shape with a portion of the main panel 12 forming the third side of the triangular configuration. As another example, the left support rail 14 may be formed by four consecutive panels that extend from the main panel 12 and are folded into a five-sided configuration with a portion of the main panel 12 forming the fifth side of the configuration. In the illustrated embodiment, the panels that form the left support rail 14 are generally planar. In alternative embodiments, one or more of the panels may have curvature or other non-planar regions.

In the illustrated embodiment, the left support rail 14 generally includes an outer panel 32, an intermediate panel 34 and an inner panel 36. When assembled, the outer panel 32 of this embodiment extends substantially perpendicularly to the main panel 12. The size, shape and configuration of the outer panel 32 may vary. For example, the width of the outer panel 32 may vary to control the depth of the left support rail 14 to correspond with the article(s) to be packaged. As another example, the angle between the outer panel 32 and the main panel 12 may vary. The outer panel 32 includes a series of openings 33*a-d* and 35*a-c* configured to receive the packaged articles (See FIG. 3). In this embodiment, the package 10 is configured to hold four screwdrivers that extend into the package 10 from the left side, and four screwdrivers S1-S4 that extend into the package 10 from the right side. Screwdrivers S1-S4 are positioned with their quillons 100 seated within the left support rail 14 between the inner panel 36 and the outer panel 32. To accommodate the quillons 100, the outer panel 32 defines a plurality of quillon openings 33*a-d* configured to receive the quillon end of the screwdrivers S1-S4 that enter the package 10 from the left side. In the illustrated embodiment, the quillon openings 33*a-d* are shaped to correspond with the cross-sectional shape of the corresponding screwdriver handle 102 at a location aligned with the outer panel 32 when the screwdriver is packaged. The left support rail 14 also supports the tip end of several of the screwdrivers S6-S8 that enter the package 10 from the right side. As a result, outer panel 32 also defines a plurality of shaft openings 35*a-c* configured to receive the shafts 104 of those screwdrivers. The shaft openings 35*a-c* may vary from application depending on the size and shape of the corresponding shaft 104. For example, shaft openings 35*a* and 35*b* are defined by a pair of cuts formed in an "X" pattern while shaft opening 35*c* is defined by a small circular opening and a pair of cuts formed in an "X" shaped arrangement. The quillon openings 33*a-d* and shaft openings 35*a-c* are described in more detail below. The number, size, shape, pattern/arrangement and configuration of quillon openings 33*a-d* and shaft opening 35*a-c* may vary from application to application.

The intermediate panel 34 extends inwardly from the outer panel 32 in a direction substantially perpendicular to the outer panel 32 and substantially parallel to the main panel 12. In this embodiment, the intermediate panel 34 is a generally rectangular plane and is of sufficient width to accommodate the quillons 100 of the packaged screwdrivers. The size, shape and configuration of the intermediate panel 34 may vary. For example, the width of the intermediate panel 34 may vary to control the spacing between the inner panel 32 and the outer panel 36. As another example, the angle between the outer panel 32 and intermediate panel 34 may vary to control the shape of the left support rail 14. Further, the shape of the intermediate panel 34 may be varied. For example, the intermediate panel 34 need not have a rectangular periphery. As another example, the intermediate panel 34 need not be planar, but instead may have curvature or otherwise be non-planar.

The inner panel 36 extends toward the main panel 12 at an angle of approximately ninety degrees from the intermediate panel 34. In this embodiment, the inner panel 36 is a generally rectangular plane that terminates at or in close proximity to the main panel 12. The size, shape and configuration of the inner panel 36 may vary. For example, the width of the inner panel 36 may vary. As another example, the angle between the inner panel 36 and the main panel 12 may vary to control the shape of the left support rail 14. Further, the shape of the inner panel 36 may be varied. For example, the inner panel 36 need not have a rectangular periphery. As another example, the inner panel 36 need not be planar, but instead may have curvature or otherwise be non-planar. The inner panel 36 of the illustrated embodiment defines a plurality of shaft openings 37*a-g* configured to receive the shafts 104 of packaged screwdrivers S1-S4 and S6-S8. To accommodate these screwdrivers, the inner panel 36 defines shaft openings 37*a-g* arranged in a staggered pattern. The number, size, shape, pattern/arrangement and configuration of the shaft openings 37*a-g* may vary from application to application. For example, shaft openings 37*a-c* are defined by a small circular opening and a concentric pair of cuts formed in an "X" pattern, while shaft openings 37*d-g* are defined by a pair of cuts formed in an "X" pattern. In the illustrated embodiment, the inner panel 36 includes interlocking features that help to secure the top and bottom closures 18 and 20 in place between the left and right support rails 14 and 16. The illustrated inner panel 36 defines a first retention slot 39 configured to receive a corresponding tab 89 extending from the inner panel 74 of the top closure 18 and a second retention slot 41 configured to receive a corresponding tab 126 extending from the inner panel 124 of the bottom closure 20. The illustrated tab/slot arrangement is optional, and it may be eliminated or varied in alternative embodiments.

In the illustrated embodiment, the right support rail 16 extends along the right edge of the main panel 12 and is largely a mirror image of the left support rail 14 differing primarily in the arrangement of openings configured to receive the packaged articles. Although the left and right support rails 14 and 16 are essentially mirror-images of one another in the illustrated embodiment, the right support rail 16 may differ from the left support rail 14. For example, the left support rail 14 and right support rail 16 may vary in size, shape, configuration and/or number of panels. These variations may be dictated by the article(s) to be packaged. Given the similarity between the right and left support rails 14 and 16, the right support rail 16 will not be separately described in as much detail as the left support rail 14. It should be noted that the description of the left support rail 14, including the illustrated embodiment and all alternative embodiments, applies to the right support rail 16, except as otherwise provided. The right support rail 16 of the illustrated embodiment generally includes an outer panel 52, intermediate panel 54 and an inner panel 56. As with outer panel 32, the outer panel 52 of the right support rail 16 defines a plurality of openings 53*a-d* and 55*a-c* configured to receive the quillons 100 of the screwdrivers S5-S8 that enter the package 10 from the right side and the shafts 104 of select screwdrivers S2-S4 that enter the package 10 from the left side (See FIG. 2). The quillon and shaft openings 53*a-d* and 55*a-c* may vary from application depending on the size and shape of the articles to be packaged. The intermediate panel 54 of the right support rail 16 is essentially identical to intermediate panel 34. The inner panel 56 of the right support rail 16 is essentially a mirror image of inner panel 36, except that it includes a different arrangement of article openings 57*a-g*, which are configured to receive the shafts of the packaged screwdrivers S2-S8. The inner panel 56 also defines slots 61 and 63 to receive the tab 90 of the top closure 18 and tab 128 of the bottom closure 20.

Figure 8:
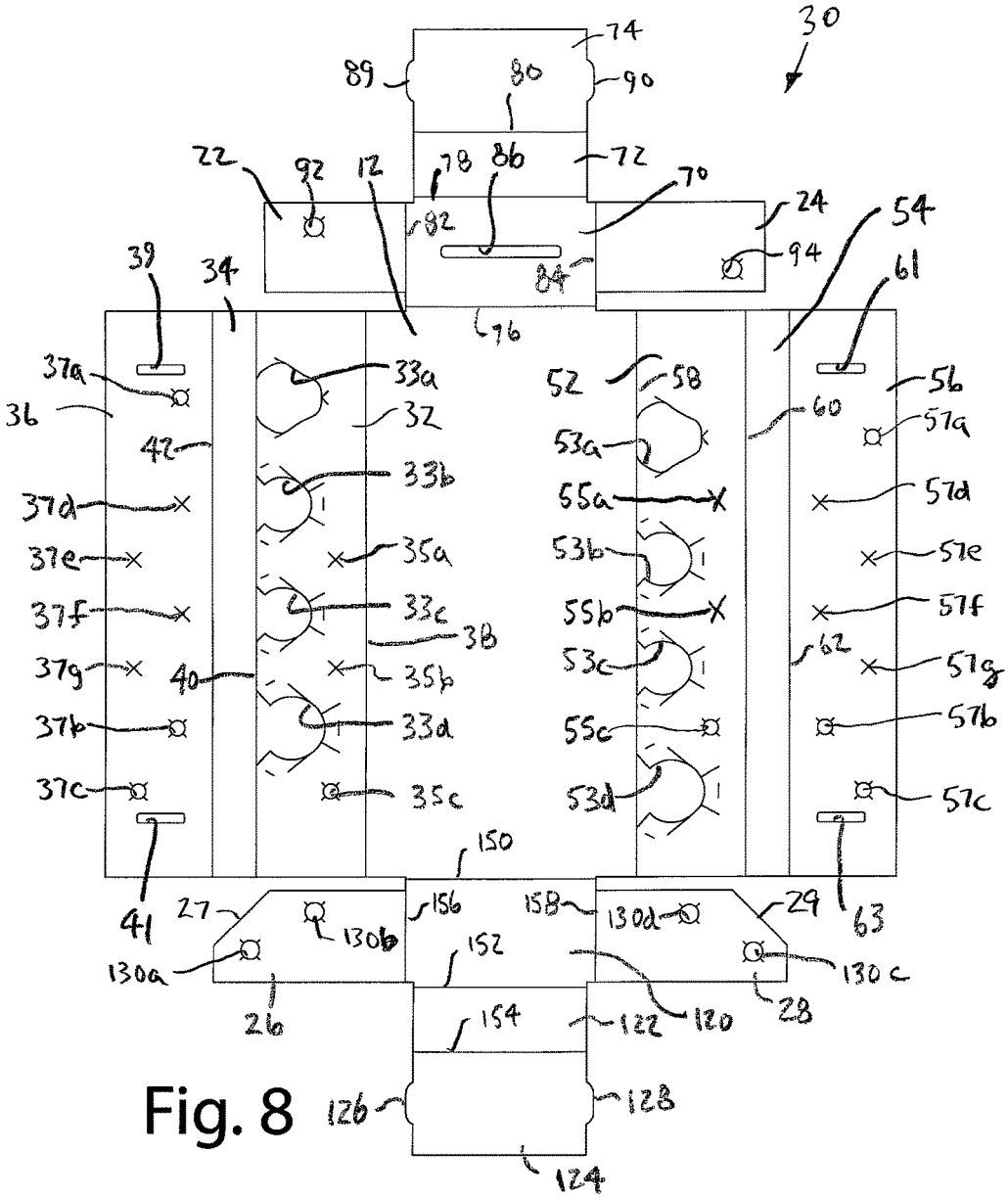
FIG. 8 is a top plan view of the blank for the package of FIGS. 1-7.

As noted above, the top end of the package 10 includes a top closure 18 having a pair of retaining flaps 22 and 24 that extend into the left support rail 14 and right support rail 16 where they are intersected by one or more packaged articles (in this case, screwdrivers S1 and S4). In the illustrated embodiment, the top closure 18 folds into the space between the left support rail 14 and the right support rail 16 to help prevent the left support rail 14 and the right support rail 16 from unfolding. Referring now to FIGS. 1 and 8, the top closure 18 of the illustrated embodiment generally includes an outer panel 70, intermediate panel 72, inner panel 74 and retaining flaps 22 and 24. In this embodiment, the top closure 18 is formed by a series of consecutive panels that are folded into a rectangular configuration with a portion of the main panel 12 forming a fourth side. As with the left and right support rails, the top closure 18 may be formed from a different number of panels that are folded into a different configuration. For example the top closure 18 may include two consecutive panels that are folded into a triangular configuration with a portion of the main panel 12 forming the third side, or the top closure 18 may include four consecutive panels that are folded into a pentagonal configuration with a portion of the main panel 12 forming the fifth side. The outer panel 70 is a generally rectangular panel that extends from the top edge of the main panel 12 at an angle of approximately ninety degrees. The size and shapes of the outer panel 70, as well as the angle between the outer panel 70 and the main panel 12 may vary from application to application. In this embodiment, the package 10 is configured to be hung from a display hook at the point of sale. To facilitate hanging, the package 10 may include a hanging tab 88 that extends from the top closure 18. In the illustrated embodiment, the hanging tab 88 is formed separately and fitted to the top closure 18. As perhaps best shown in FIG. 8, the top closure 18 defines a slot 86 configured to receive a hanging tab 88. The size, shape and configuration of the slot 86 may vary to correspond with the desired hanging tab 88.

In the illustrated embodiment, the retaining flaps 22 and 24 extend from opposite edges of the outer panel 70. As shown, each retaining flap 22 and 24 is generally rectangular and defines an opening 92 and 94 configured to receive a portion of a packaged article. In this embodiment, each retaining flap 22 and 24 is configured to intersect with the shaft of a different screwdriver. More specifically, retaining flap 22 intersects with the shaft of screwdriver S1 and retaining flap 24 intersects with the shaft of screwdriver S5. In this embodiment, the screwdrivers S1 and S5 are stubby screwdrivers, which each have a shaft 104 that extends through only one support rail 14 or 16. When packaging full length screwdrivers at the top of the package 10, each retaining flap 22 and 24 may be configured to intersect with two screwdrivers. In such embodiments, each retaining flap 22 and 24 can define an additional opening positioned to align with the shaft of the corresponding screwdrivers. In this embodiment, the retaining flaps 22 and 24 extend into the interior of the support rails 14 and 16. In alternative embodiments, the retaining flaps 22 and 24 may extend outside of the support rails 14 and 16. For example, the retaining flaps may alternatively extend along the internal surface of the inner panels 36 and 56.

The intermediate panel 72 extends from the outer panel 70 at an angle of approximately 90 degrees. This angle may vary from application to application. The illustrated intermediate panel 72 is a generally rectangular plane, but its size, shape and configuration may vary. For example, the intermediate panel 72 may have a non-rectangular periphery. As another example, the intermediate panel 72 may have curvature or otherwise have a non-planar shape.

The inner panel 74 is generally rectangular and extends from the intermediate panel 72 at an angle of approximately 90 degrees. The inner panel 74 terminates at or adjacent to the main panel 12. The angle between the inner panel 74 and the intermediate panel 72 may vary from application to application. The illustrated inner panel 74 is generally rectangular, but its shape may vary. Tabs 89 and 90 extend from opposite edges of the inner panel 74. As noted above, the tabs 89 and 90 are configured to be fitted into corresponding slots 39 and 61 in the left support rail 14 and the right support rail 16.

Figure 9:
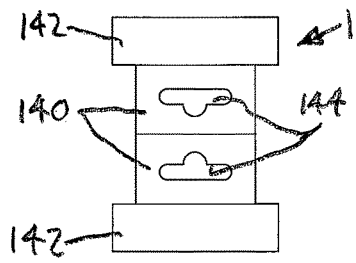
FIG. 9 is a top plan view of the blank for the hanging tab.

In this embodiment, the package 10 is intended for use as a point-of-sale package that can be suspended from a display hook at the point of sale. To facilitate this, the package 10 includes a hanging tab 88 that protrudes upwardly from the outer panel 70 of the top closure 18 to provide a structure for hanging the package 10 from a display hook. In this embodiment, the hanging tab 88 is separately manufactured and installed through the hanging tab slot 86 in the top closure 18. Referring now to FIG. 9, the hanging tab 88 is formed from a single piece of paperboard (blank 138) and may include a pair of exposed panels 140 and a pair of retaining panels 142. As shown, the exposed panels 140 are disposed in coextensive, side-by-side relationship and extend through the hanging tab slot 86 to protrude above the package 10. The exposed panels 140 define a hanging hole 144 that can be fitted over a display hook (not shown) at the point of sale or other similar structures. The retaining panels 142 are longer than the hanging tab slot 86 and therefore remain trapped beneath the outer panel 70 of the top closure 18. The hanging tab 88 of the illustrated embodiment is merely exemplary and the package 10 may be manufactured without a hanging tab or the configuration of the hanging tab may be varied to meet the needs of a particular application. In alternative embodiments, a hanging hole can be incorporated into the package 10 other than a hanging tab 88. For example, the hanging hole may be incorporated into the top closure 18. More specifically, the hanging hole may include openings defined in the intermediate panel 72 and the main panel 12. With this alternative, the display hook (not shown) may extend through the intermediate panel 27 and the main panel 12. As another example, the hanging hole may be defined by an opening in the main panel 12 that allows the display hook to extend though through the main panel 12.

In the illustrated embodiment, the bottom closure 20 is essentially a mirror image of the top closure 18, except as described and shown in the drawings. The bottom closure 20 generally includes an outer panel 120, an intermediate panel 122, an inner panel 124 and retaining flaps 26 and 28. Unlike the top closure 18, the outer panel 120 of the bottom closure 20 does not include a slot for receiving a hanging tab. The outer panel 120 is otherwise essentially identical to outer panel 70. The intermediate panel 122 of the bottom closure 20 is essentially identical to intermediate panel 72. The inner panel 124 of the bottom closure 20 is essentially identical to inner panel 74, and includes tabs 126 and 128 configured to be interfitted with the left and right support rails 14 and 16. The shape of the retaining flaps 26 and 28 and the configuration of the openings 130*a-d* in the retaining flaps 26 and 28 vary from those of top closure 18. For example, in this embodiment, retaining flaps 26 and 28 are longer than retaining flaps 22 and 24, and they include angled corners 27 and 29. The angled corners 27 and 29 may prevent the retaining flaps 26 and 28 from interfering with installation of screwdriver S3 in the package 10. In this embodiment, each retaining flap 26 and 28 includes a pair of opening 130*a-d* that allow the bottom two screwdrivers S4 and S8 to be fitted through the retaining flaps 26 and 28. More specifically, in this embodiment, the package 10 includes two screwdrivers S4 and S8 with full left shafts seated in the bottom two positions. The shafts 104 of these bottom two screwdrivers S4 and S8 extend through the openings 130*a-d* in both retaining flaps 26 and 28.

C. Blanks

As noted above, the package 10 is formed primarily from a single one-piece paperboard blank 30, which is described in more detail below (See FIG. 8). In this embodiment, the hanging tab 88 is formed from a separate paperboard blank 138 (See FIG. 9), which is formed and added to the package 10 during assembly. It should be noted that the term "paperboard" is used herein to refer to all paper-based and fiber-based materials that might prove suitable for forming a package in accordance with an embodiment of the present invention, such as paperboard, containerboard, posterboard, composition board, boxboard, folding boxboard, cardboard, fiberboard, laminated board, corrugated cardboard and corrugated fiberboard. The term is also intended to encompass essentially any materials that may not be paper-based or fiber-based, but can nonetheless perform in a manner analogous to paper-based and fiber-based materials, such as corrugated plastic and foam board.

Referring now to FIG. 8, the package 10 is manufactured from a paperboard blank 30. In this embodiment, the blank 30 includes a main panel 12 that is generally rectangular. The size and shape of the main panel 12 may vary from application to application, as desired. For example, the length and/or width of the main panel 12 may be configured to correspond with the article or articles to be retained within the package 10. Further, the peripheral shape of the main panel 12 may be varied to control the spacing and relative orientation of the left and right support rails 14 and 16. For example, the main panel 12 may include non-parallel edges to provide non-parallel support rails 14 and 16. This may facilitate packaging of articles of different sizes. As another example, the package may include a main panel with a different number of sides or edges. For example, in an alternative package, the main panel may be triangular, pentagonal, hexagonal or octagonal. In these alternative embodiments, the support rails may be reconfigured to follow the peripheral shape of the main panel. For example, with an octagonal main panel, the left and right rails may each be formed by three segments that correspond with three sides of the octagonal, and the top closure and bottom closure may extend from the top and bottom sides of the octagon.

In the illustrated embodiment, each of the left and right support rails 14 and 16 is formed by a number of consecutive panels that are folded to form into a hollow rectilinear structure. Referring now to blank 30, the left support rail 14 generally includes an outer panel 32, intermediate panel 34 and an inner panel 36. The names of these panels are selected to correspond to the relative position of these panels in the folded package 10. The outer panel 32 is joined to the main panel 12 along a fold line 38. For purposes of disclosure, the term "fold line" is used to refer to any and all features that may be provided to a paperboard blank to facilitate or assist in forming a fold. The term should be broadly interpreted to include fold lines, score lines, cut lines, partial cut lines, perforations, intermittent score lines, intermittent cut lines, lines of weakening and the like. The intermediate panel 34 is joined to the outer panel 32 along a fold line 40. The inner panel 36 is joined to the intermediate panel 34 along a fold line 42. The outer panel 32 defines a plurality of quillon openings 33*a-d* configured to allow the quillons 100 of screwdrivers S1-S4 to be inserted into the left support rail 14. In this embodiment, the size and shape of each quillon opening 33*a-d* generally corresponds with the cross-sectional size and shape of the portion of the handle 102 that is aligned with quillon opening 33*a-d* when the screwdriver is properly seated in the package 10. As can be seen, quillon opening 33*a* has a different shape that quillon openings 33*b-d*. This is because screwdriver S1 (which is fitted into quillon opening 33*a*) has a different shape than screwdrivers S2-S4 (which are fitted into quillon openings 33*b-d*). More specifically, in this embodiment, screwdriver S1 is a stubby screwdriver that is more triangular in cross-section at the interface location, while screwdrivers S2-S4 are full length screwdrivers that are more circular in cross-section at the interface location. Each quillon opening 33*a-d* may include a series of associated cuts that allow the paperboard around the opening 33*a-d* to flex and bend as needed to allow insertion of the quillon 100 through the opening 33*a-d*. For example, in the context of the screwdrivers S1-S8, the quillon 100 is larger than the portion of the handle 102 that will be seated in the quillon opening 33*a-d*. Accordingly, the paperboard blank around the quillon opening 33*a-d* is cut to define flaps or fingers that are capable of flexing or bending to accommodate passage of the quillon 100. Additional cuts may be formed at the base of the flaps to along controlled bending of the paperboard about those additional cuts. The inherent resiliency of the paperboard will allow the flaps or finger to close about the handle 102 after the quillon 100 has passed. The outer panel 32 also defines a plurality of shaft openings 35*a-c* configured to receive the shafts 104 of screwdrivers S6-S8. Similarly, the inner panel 36 defines a plurality of shaft openings 37*a-g* configured to receive the shafts 104 screwdrivers S1-S4 and S6-S8. The size and shape of each shaft opening 35*a-c* and 37*a-g* may vary depending on the article to be seated in that hole. For example, with smaller diameter shafts, the shaft openings may include one or more cuts that allow the article to pass through the panel. In the illustrated embodiment, shaft openings 35*a-b* and 37*d-g* are defined by a pair of cuts that intersect in an "X" pattern. With larger diameter shafts, the shaft openings may be defined by the removal of material from the panel. In the illustrated embodiment, shaft openings 35*c* and 37*a-c* are defined by a circular die cut aligned with a pair of cuts that intersect in an "X" pattern. The inner panel 36 may also define a pair of slots 39 and 41 configured to receive tabs 89 and 126 extending from the top closure 18 and the bottom closure 20. This tab and slot arrangement may help to retain the inner panel 36 in the desired final position.

The right support rail 16 generally includes an outer panel 52, intermediate panel 54 and an inner panel 56. The outer panel 52 is joined to the main panel 12 along a fold line 58. The intermediate panel 54 is joined to the outer panel 52 along a fold line 60. The inner panel 56 is joined to the intermediate panel 54 along a fold line 62. The outer panel 52 defines a plurality of quillon openings 53*a-d* configured to allow the quillons 100 of screwdrivers S5-S8 to be inserted into the right support rail 16. The outer panel 52 also defines a plurality of shaft openings 55*a-c* configured to receive the shafts 104 of screwdrivers S2-S4. The inner panel 56 defines a plurality of shaft openings 57*a-g* configured to receive the shafts 104 screwdrivers S2-S8. The inner panel 56 also defines a pair of slots 61 and 63 configured to receive tabs 90 and 128 extending from the top closure 18 and the bottom closure 20.

In this embodiment, the quillon openings 33*a-d* and 53*a-d* are configured to hold the screwdrivers S1-S8 in the desired orientation. For example, the quillon openings can be configured to hold the screwdrivers so that the logos presented on the handles are facing forward. In the illustrated embodiment, the screwdrivers have handles that are generally triangular in cross-section. As shown, the quillon openings 33*a-d* are positioned adjacent to the main panel 12 so that a flat surface of each handle 102 seated in the left support rail 14 is engaged with and extends along the main panel 12. Interaction between the flat surface of the handle 102 and the flat surface of the main panel 12 helps to resist rotation of the screwdriver once packaged. Similarly, the quillon openings 53*a-d* are positioned adjacent to the intermediate panel 54 so that a flat surface of each handle 102 seated in the right support rail 16 is engaged with and extends along the intermediate panel 54. As noted above, the blank 30 includes a series of cuts arranged around each quillon opening 33*a-d* and 53*a-d* to provide flaps or fingers arranged in a triangular configuration to accommodate insertion of a triangularly-shaped object in the desired orientation. As such, the position of the quillon openings 33*a-d* and 53*a-d* relative to the main panel 12 and intermediate panel 54, and the triangular configuration of the flaps or fingers cooperatively facilitate insertion of the screwdrivers into the package in the correct orientation. In the illustrated embodiment, the flaps or fingers are configured to be slightly longer that would be required to correspond with the external shape of the handle 102, such that the inner edges of the flaps or fingers are slightly smaller than the cross-sectional shape of the handle 102. In use, insertion of the screwdriver into the support rails 14 and 16 causes the flaps or fingers to bend inwardly to allow passage of the quillon 100. After passage of the quillon 100, the flaps or fingers spring back toward their original position. Because the flaps or fingers are slightly longer, they engage the handle 102 before fully returning to their original position. As a result, the flaps or fingers remain at a slight bend, which help to resists removal of the screwdriver from the package 10. In alternative applications, the quillon openings, including the flaps/fingers, may be adapted or modified to correspond with the article(s) to be packaged in the package. For example, the flaps or finger may be adapted or modified to correspond with the size, shape and configuration of the packaged article(s) to assist in shepherding insertion of the article(s) into the package in the desired orientation and/or to hold the packaged article(s) in the desired orientation. More specifically, the quillon openings may be surrounded by an alternative arrangement of cuts that form a different number, size or arrangement of flaps or fingers. For example, the quillon opening may include four flaps or fingers the correspond with an article that has four sides. As another example, the flaps or fingers may be shortened to make it easier to remove the article(s) from the package or lengthened to make it more difficult to remove the packaged article(s).

The top and bottom closures 18 and 20 are configured to fold into the space between the left and right support rails 14 and 16. When folded into these positions, the top and bottom closure 18 and 20 hold the left and right support rails 14 and 16 in the folded configuration. The top closure 18 generally includes an outer panel 70, intermediate panel 72, an inner panel 74 and a pair of retaining flaps 22 and 24. The outer panel 70 is joined to the main panel 12 along a fold line 76. The intermediate panel 72 is joined to the outer panel 70 along a fold line 78. The inner panel 74 is joined to the intermediate panel 72 along a fold line 80. The retaining flaps 22 and 24 are joined to the outer panel 70 along fold lines 82 and 84. The outer panel 70 of the top closure 18 is generally rectangular and defines an elongated slot 86 configured to receive a hanging tab 88 (described in more detail below) for hanging the package 10 from a display hook or similar structure. In this embodiment, the slot 86 is generally centrally located, but its position may vary from application to application, as desired. In applications that do not include a hanging tab, the slot 86 may be eliminated. The inner panel 74 includes a pair of tabs 89 and 90 that extend from opposite ends to extend into corresponding slots 39 and 61 in the inner panels 36 and 56 of the left and right support rails 14 and 16. In this embodiment, the retaining flaps 22 and 24 are configured to extend into the left and right support rails 14 and 16 a sufficient distance to be intersected by two packaged screwdrivers S1 and S5. To facilitate insertion of the screwdrivers S1 and S4, each retaining flap 22 and 24 includes an opening 92 and 94 of sufficient size to accommodate the corresponding screwdriver shaft. As perhaps best shown in FIG. 7, each opening 92 and 94 may include a small circular opening and a pair of cuts arranged in an "X"-shaped pattern.

In this embodiment, the bottom closure 20 is similar to the top closure 18, except that retaining flaps 26 and 28 differ somewhat from retaining flaps 22 and 24. The bottom closure 20 generally includes an outer panel 120, intermediate panel 122, an inner panel 124 and a pair of retaining flaps 26 and 28. The outer panel 120 is joined to the main panel 12 along a fold line 150. The intermediate panel 122 is joined to the outer panel 120 along a fold line 152. The inner panel 124 is joined to the intermediate panel 122 along a fold line 154. The retaining flaps 26 and 28 are joined to the outer panel 120 along fold lines 156 and 158. The inner panel 124 includes a pair of tabs 126 and 128. In this embodiment, the retaining flaps 26 and 28 each define two openings 130*a-d* of sufficient size to receive the shafts 104 of the two bottom-most screwdrivers S4 and S8. Each opening 130*a-d* may include a small circular opening and a pair of cuts arranged in an "X"-shaped pattern.

D. Assembly

The package 10 is formed by folding the various panels of the blank 30 into the desired shape. Although there is some flexibility in the order in which the panels are folded, one method for folding the blank 30 into the package 10 will be described. As noted above, the package 10 is formed from package blank 30 and hanging tab blank 138. In this method, the hanging tab blank 138 is formed first by folding the blank 138 along its centerline to move the exposed panels 140 and the retaining panels 142 into side-by-side relationship. The exposed panels 140 are then fitted through slot 86 in the outer panel 70 of the top closure 18. The retaining panels 142 may be folded away from each other to lay flat along the outer panel 70. The hanging tab 88 may alternatively be folded and inserted into the top closure 18 at essentially any time prior to folding the inner panel 74 of the top closure 18 down into its final position. The package blank 30 may next be folded to complete formation of the package 10. In this method, the left and right support rails are formed first and then the top and bottom closures are formed. Before the left and right support rails 14 and 16 are formed, however, the top and bottom closures 18 and 20 are partially folded so that the left and right support rails 14 and 16 can be formed around the retaining flaps 22, 24, 26 and 28. More specifically, in this embodiment, the outer panels of the top and bottom closures 18 and 20 are folded up approximately ninety degrees. The retaining flaps 22, 24, 26 and 28 are then folded inwardly approximately ninety degrees so that are disposed in the space that will be surrounded by the left and right support rails 14 and 16. The outer panel of the left support rail 14 may then be folded upward approximately ninety degrees. The intermediate panel of the left support rail 14 is then folded inwardly approximately ninety degrees. The inner panel of the left support rail 14 is then folded downwardly approximately ninety degrees to form a rectangular rail that entraps the retaining flaps 22 and 26. The same process may then be repeated to fold the right support rail 16 to form a rectangular rail that entraps the retaining flaps 24 and 28.

The top and bottom closures 18 and 20 can then be folded to complete the package 10. More specifically, the intermediate panel of the top closure 18 may be folded inwardly approximately ninety degrees, and then the inner panel of the top closure 18 may be folded downwardly approximately ninety degrees into the space between the left and right support rails 14 and 16. The tabs 89 and 90 on opposite ends of the inner panel are fitted into slots 39 and 61 in the inner panel of the left support rail 14 and the inner panel of the right support rail 16. The process may be repeated for the bottom closure 20. More specifically, the intermediate panel of the bottom closure 20 may be folded inwardly approximately ninety degrees, and then the inner panel of the bottom closure 20 may be folded downwardly approximately ninety degrees into the space between the left and right support rails 14 and 16. The tabs 126 and 128 on opposite ends of the inner panel are fitted into slots 41 and 63 in the inner panel of the left support rail 14 and the inner panel of the right support rail 16.

Figure 5:
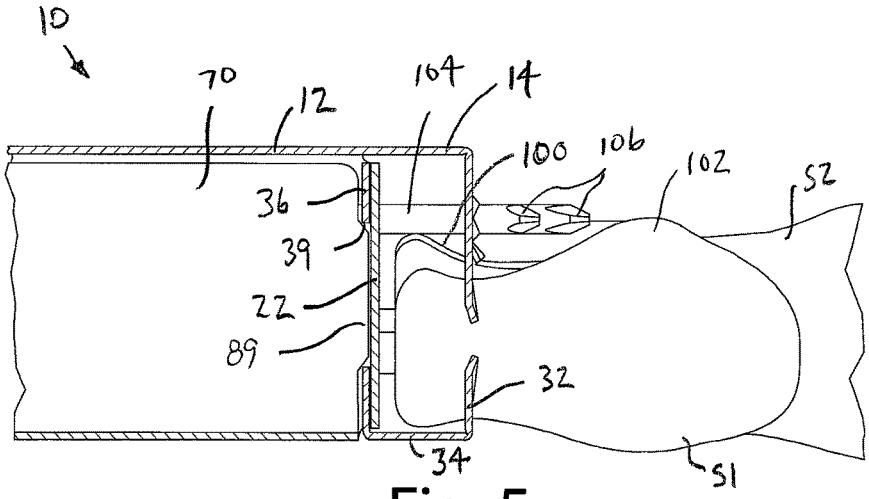
FIG. 5 is a sectional view of the package taken along line 5-5 of FIG. 4.
Figure 6:
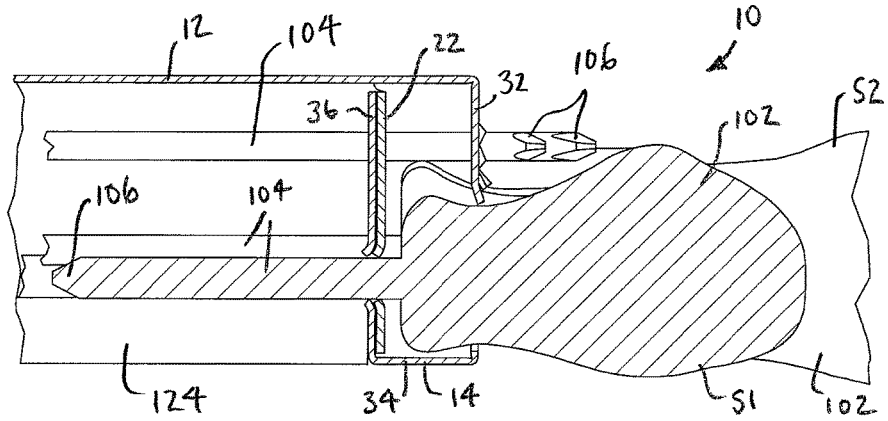
FIG. 6 is a sectional view of the package taken along line 6-6 of FIG. 4.
Figure 7:
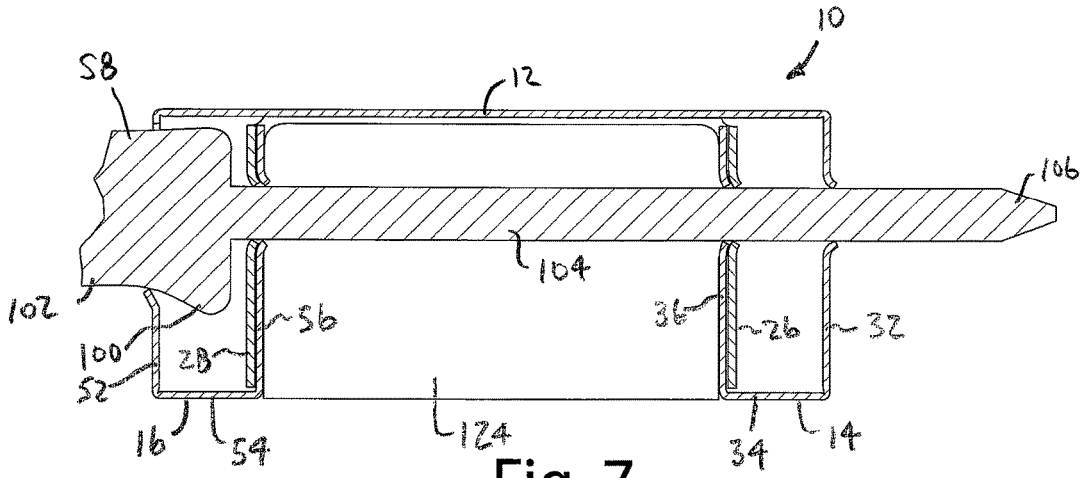
FIG. 7 is a sectional view of the package taken along line 7-7 of FIG. 4.

Referring now to FIGS. 5-7, the packaged articles, in this case screwdrivers S1-S8, are fitted into the support rails 14 and 16, extend through the retaining flaps 22, 24, 26 and 28. More specifically, screwdrivers S1-S4 are fitted into the left support rail 14 by inserting the screwdriver shafts into the left support rail 14 and pushing them to the right until the quillons 100 have passed through the outer panel 32 of the left support rail 14 and are seated in the space between the inner panel 36 and the outer panel 32 of the left support rail 14. This also causes the shafts of screwdrivers S2-S4 to pass through the openings in the inner panel 56 and the outer panel 52 of the right support rail 16 with the tips 106 exposed outside the package 10. Similarly, screwdrivers S5-S8 are fitted into the right support rail 16 by inserting the screwdriver shafts into the right support rail 16 and pushing them to the left until the quillons 100 have passed through the outer panel of the right support rail 16 and are seated in the space between the inner and outer panels of the right support rail 16. This causes the shafts of screwdrivers S6-S8 to pass through the openings in the inner and outer panels of the left support rail 14 with the tips 106 exposed outside the package 10.

Although the package 10 is described without any adhesive or other fasteners securing the retaining flaps 22, 24, 26 and 28, the package 10 may be provided with adhesive and/or fasteners, as desired. For example, the package 10 may include adhesive that joins the retaining flaps to the left and right support rails. As another example, tape, staples or other forms of fasteners may be used to secure the retaining flaps to the left and right support rails.

E. Select Alternative Embodiments

The present invention is readily adapted for use in a wide variety of alternative embodiments. For example, the package can be adapted to package different articles, different numbers of articles and to package articles in a different arrangements. As an illustration, various alternative embodiments are shown in FIGS. 10-13.

Figure 10:
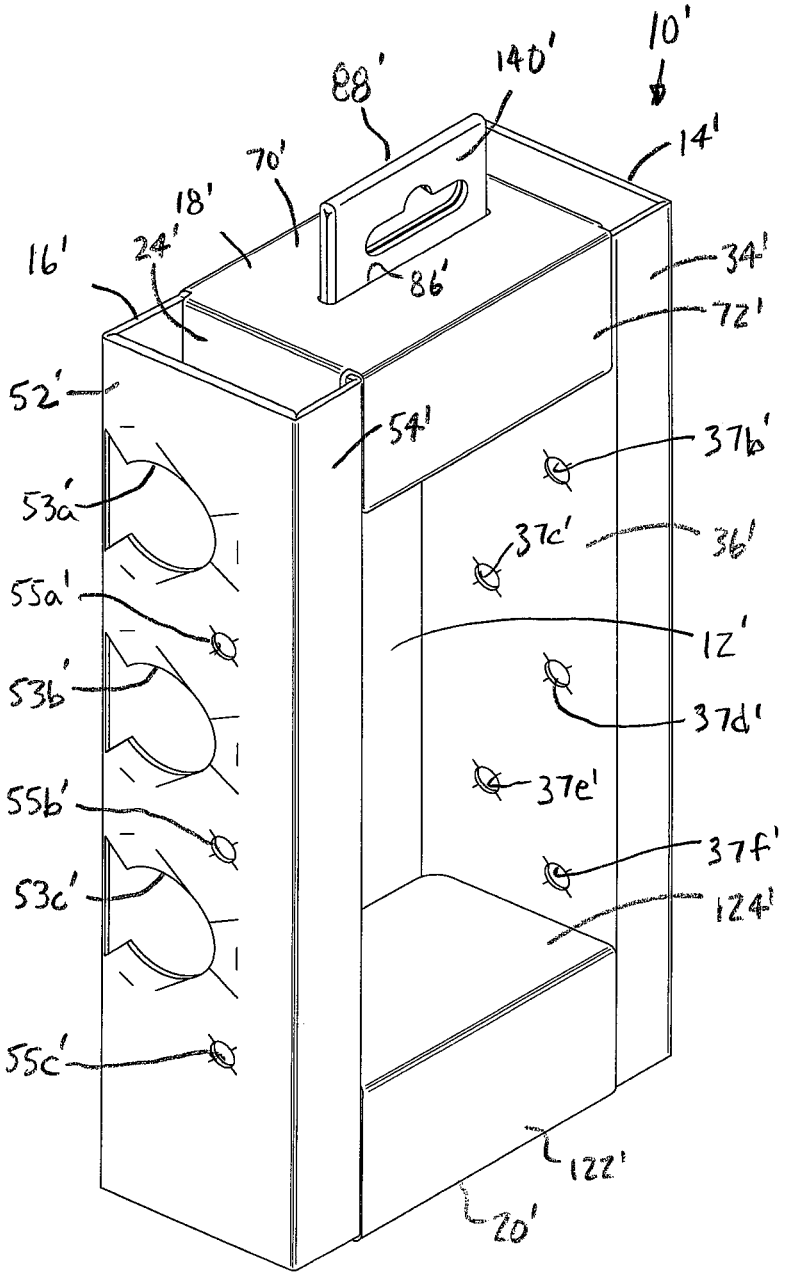
FIG. 10 is a rear perspective view of a first alternative package.
Figure 11:
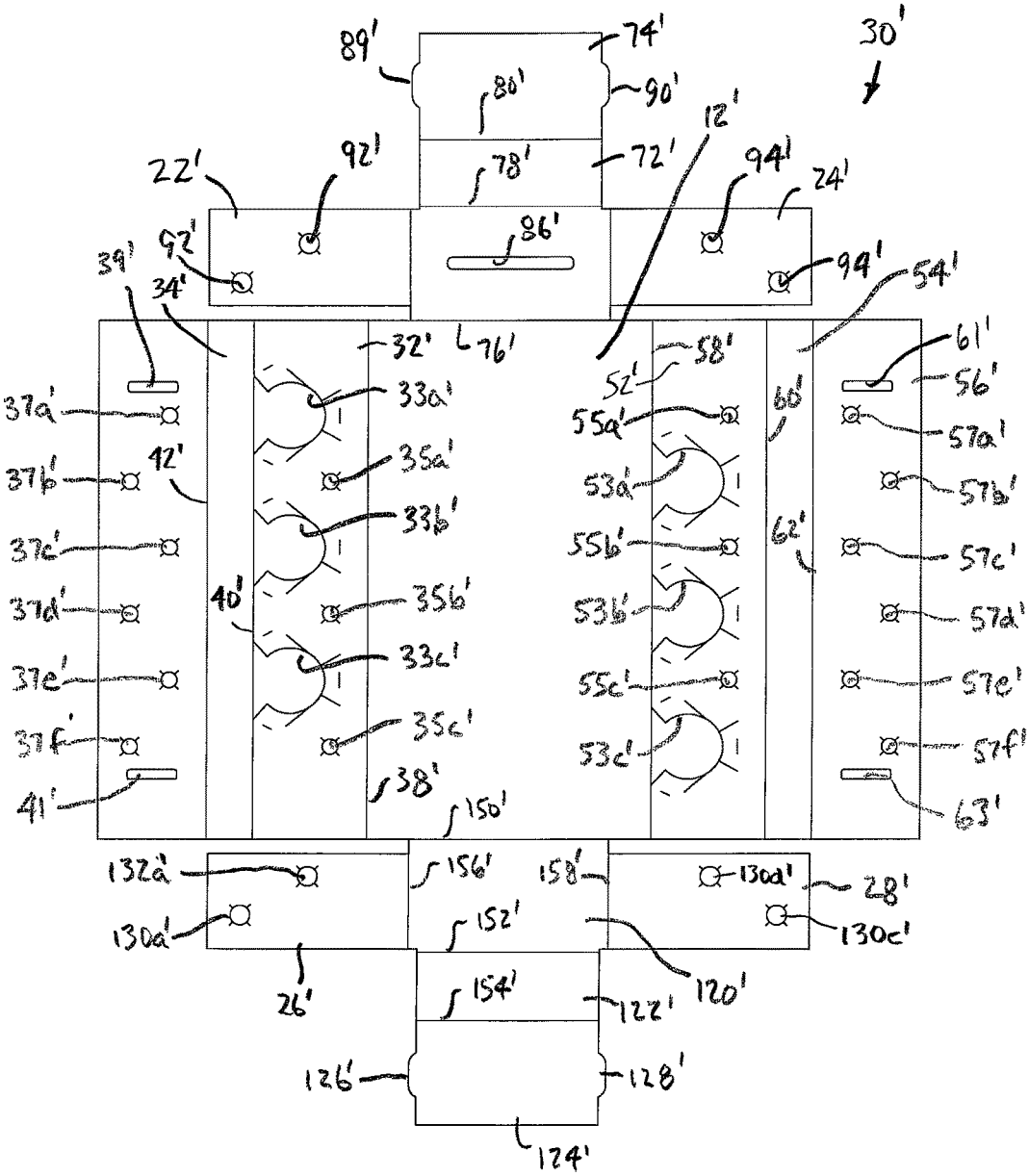
FIG. 11 is a top plan view of the blank for the first alternative package.

FIGS. 10 and 11 show an alternative embodiment configured to package a different set of screwdrivers. In this embodiment, the package 10' is configured to package six screwdrivers. Package 10' incorporates a number of modifications intended to accommodate the six-piece screwdriver set, but is otherwise generally identical to package 10. As a result, package 10' will not be described in great detail. In this embodiment, package 10' is shorter in the vertical direction and the article openings are configured to receive six rather than eight screwdrivers. Further, the retaining flaps 22', 24', 26' and 28' have a somewhat different shape and each one of them includes two shaft openings. For purposes of disclosure, alternative package 10' is described and shown in FIGS. 10 and 11 with reference numerals that correspond with those of like components in package 10, except that each reference numeral for package 10' is followed by a "'" symbol (prime symbol).

The blank for package 10' is shown in FIG. 11. As can be seen, the blank 30' is similar to blank 30 and therefore will not be described in great detail. The blank 30' includes a main panel 12' that is generally rectangular. Each of the left and right support rails 14' and 16' is formed by a number of consecutive panels that are folded to form into a hollow rectilinear structure. The left support rail 14' generally includes an outer panel 32', intermediate panel 34' and an inner panel 36'. The outer panel 32' is joined to the main panel 12' along a fold line 38'. The intermediate panel 34' is joined to the outer panel 32' along a fold line 40'. The inner panel 36' is joined to the intermediate panel 34' along a fold line 42'. The outer panel 32' defines a plurality of quillon openings 33*a-c*' and shaft openings 35*a-c*'. The inner panel 36' defines a plurality of shaft openings 37*a-f*'. The inner panel 36' also defines a pair of slots 39' and 41'. The right support rail 16' generally includes an outer panel 52', intermediate panel 54' and an inner panel 56'. The outer panel 52' is joined to the main panel 12' along a fold line 58'. The intermediate panel 54' is joined to the outer panel 52' along a fold line 60'. The inner panel 56' is joined to the intermediate panel 54' along a fold line 62'. The outer panel 52' defines a plurality of quillon openings 53*a-c*' and shaft openings 55*a-c*'. The inner panel 56' defines a plurality of shaft openings 57*a-f*'.

The top closure 18' generally includes an outer panel 70', intermediate panel 72', an inner panel 74' and a pair of retaining flaps 22' and 24'. The outer panel 70' is joined to the main panel 12' along a fold line 76'. The intermediate panel 72' is joined to the outer panel 70' along a fold line 78'. The inner panel 74' is joined to the intermediate panel 72' along a fold line 80'. The retaining flaps 22' and 24' are joined to the outer panel 70' along fold lines 82' and 84'. The outer panel 70' defines an elongated slot 86' configured to receive a hanging tab 88'. The inner panel 74' includes a pair of tabs 89' and 90'. In this embodiment, the retaining flaps 22' and 24' each define openings 92' and 94'. The bottom closure 20' includes an outer panel 120', intermediate panel 122', an inner panel 124' and a pair of retaining flaps 26' and 28'. The outer panel 120' is joined to the main panel 12' along a fold line 150'. The intermediate panel 122' is joined to the outer panel 120' along a fold line 152'. The inner panel 124' is joined to the intermediate panel 122' along a fold line 154'. The retaining flaps 26' and 28' are joined to the outer panel 120' along fold lines 156' and 158'. The inner panel 124' includes a pair of tabs 126' and 128'. In this embodiment, the retaining flaps 26' and 28' each define openings 130*a-d*'. Package 10' can be formed using essentially the same method discussed above in connection with package 10.

Figure 12:
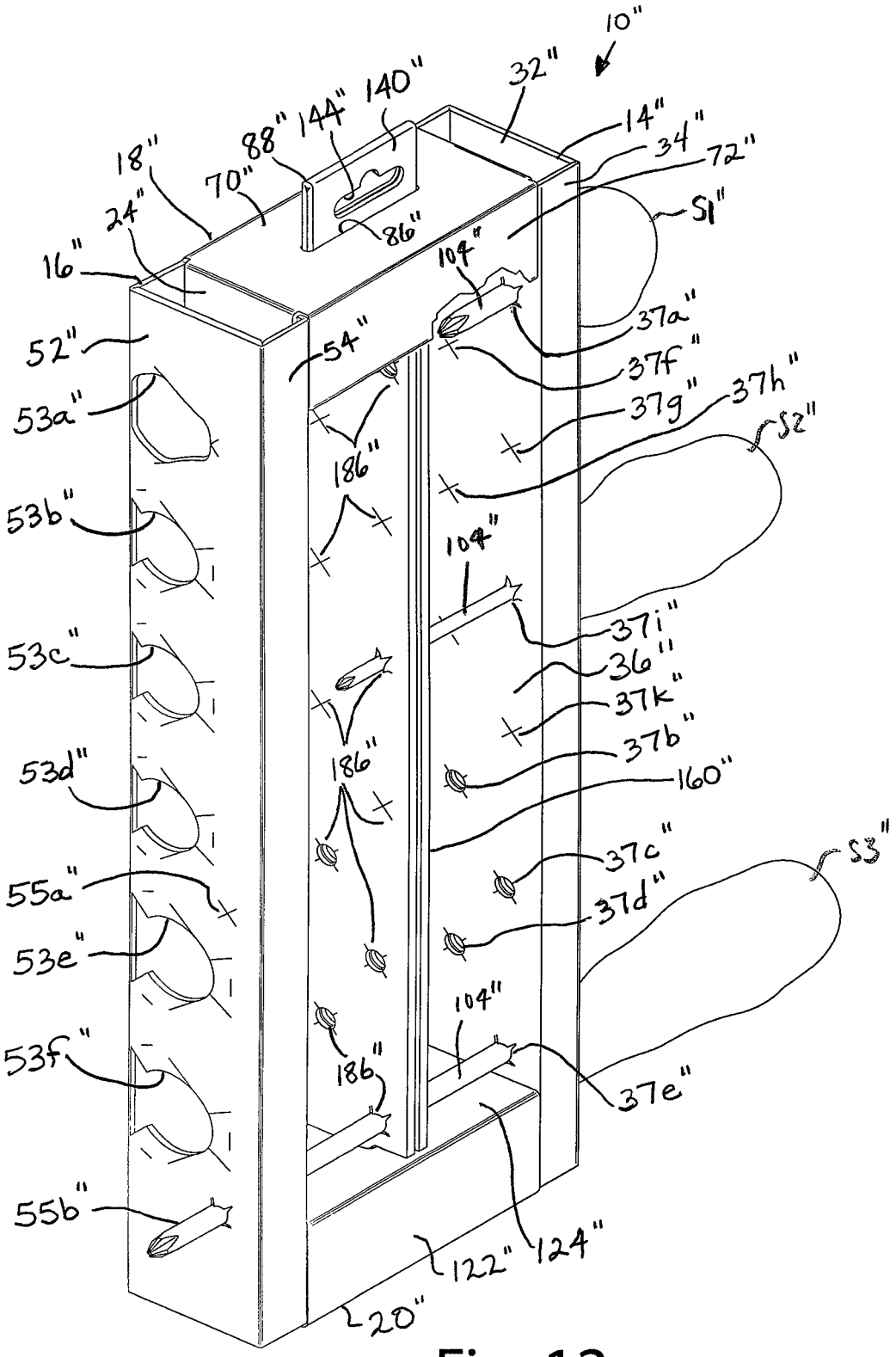
FIG. 12 is a rear perspective view of a second alternative package.
Figure 13:
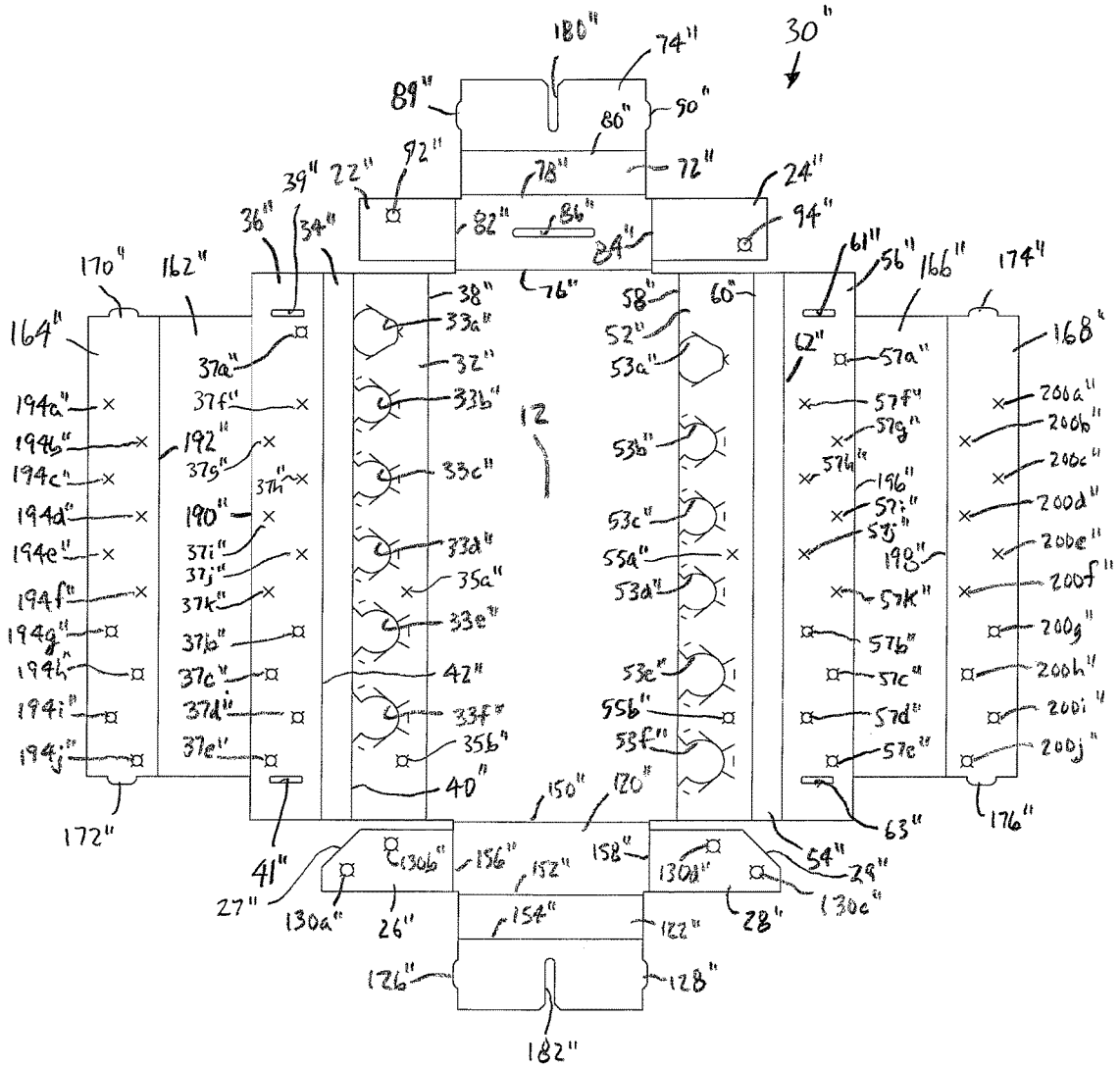
FIG. 13 is a top plan view of the blank for the second alternative package.

FIGS. 12 and 13 illustrate another alternative embodiment configured to package another set of screwdrivers. In this embodiment, the package 10" is configured to package of set of twelve screwdrivers. Package 10" incorporates a number of modifications intended to accommodate the twelve-piece screwdriver set, but is otherwise generally identical to package 10. As a result, package 10" will not be described in great detail. In this embodiment, package 10" is longer in the vertical direction, wider in the horizontal direction, defines article openings configured to receive twelve rather than eight screwdrivers and includes a central beam 160" (See FIG. 12) to provide supplemental support of the packaged screwdrivers. For purposes of disclosure, alternative package 10" is described and shown in FIGS. 12 and 13 with reference numerals that correspond with those of like components in package 10, except that each reference numeral for package 10" is followed by a "" "symbol (double prime symbol).

To accommodate this twelve-piece screwdriver set, the package 10" includes a central beam 160" defined by supplemental panels joined to the left and right support rails 14" and 16". In the illustrated embodiment, central beam 160" is defined by a bridge panel 162" and a beam panel 164" extending from the left support rail 14" and a bridge panel 166" and a beam panel 168" extending form the right support rail 16". During assembly the bridge panels 162" and 166" are folded approximately ninety degrees inwardly from the inner panels 36" and 56" to extend along the main panel 12", and the beam panels 164" and 168" are folded approximately ninety degrees upwardly from the bridge panels 162" and 166". As shown, in this embodiment, opposite ends of the beam panels 164" and 168" include tabs 170", 172", 174" and 176" that are interfitted with corresponding slots 180" and 182" defined in the inner panels 74" and 124" of the top and bottom closures 18" and 20". In this embodiment, the bridge panels 162" and 166" are configured to position the beam panels 164" and 168" in immediately adjacent, side-by-side coextensive relationship. In alternative embodiments, the bridge panels may be configured to provide a space between the beam panels. In such alternative embodiments, the inner panels of the top and bottom closure may include spaced-apart slots configured to receive tabs extending from the spaced-apart beam panels. As perhaps best shown in FIG. 12, the beam panels 164" and 168" define a plurality of openings 186" configured to receive and support the shafts of screwdrivers. The size, shape and configuration of the openings 186" may vary from application to application to accommodate different packaged articles.

Package 10" is shown in FIG. 12 with three packaged screwdrivers S1"-S3" that have different length shafts 104". These three screwdrivers S1"-S3" are shown to illustrate how screwdrivers with different length shafts might interfit with the central beam 160". More specifically, the shaft 104" of screwdriver S1" terminates short of the central beam 160", the shaft 104" of screwdriver S2" extends through the central beam 160", but terminates short of the opposite support rail 16" and the shaft 104" of screwdriver S3" extends through both support rails 14" and 16" and the central beam 160". These alternative screwdrivers S1"-S3" are merely exemplary, and the package 10" can be used to package screwdrivers of lengths not shown in FIG. 12.

The blank for package 10" is shown in FIG. 13. In this embodiment, the blank 30" includes a main panel 12" that is generally rectangular. The size and shape of the main panel 12" may vary from application to application, as desired. As with package 10, the left and right support rails 14" and 16" of package 10" are formed by a number of consecutive panels that are folded to form into a hollow rectilinear structure. The left support rail 14" generally includes an outer panel 32" joined to the main panel 12" along fold line 38", an intermediate panel 34" joined to the outer panel 32" along a fold line 40" and an inner panel 36" joined to the intermediate panel 34" along a fold line 42". The outer panel 32" defines a plurality of quillon openings 33*a-f'* configured to allow the quillons 100 of corresponding screwdrivers to be inserted into the left support rail 14". The outer panel 32" also defines a plurality of shaft openings 35*a-b"* configured to receive the shafts of corresponding screwdrivers. Similarly, the inner panel 36" defines a plurality of shaft openings 37*a-k"* configured to receive the shafts of corresponding screwdrivers. The size and shape of each shaft opening 35*a-b"* and 37*a-k"* may vary depending on the article to be seated in that opening. The inner panel 36" may also include a pair of slots 39" and 41" configured to receive tabs 89" and 126" extending from the top closure 18" and the bottom closure 20".

The right support rail 16" generally includes an outer panel 52" joined to the main panel 12" along a fold line 58", an intermediate panel 54" joined to the outer panel 52" along a fold line 60" and an inner panel 56" joined to the intermediate panel 54" along a fold line 62". The outer panel 52" defines a plurality of quillon openings 53*a-f'* configured to allow the quillons of corresponding screwdrivers to be inserted into the right support rail 16". The outer panel 52" also defines a plurality of shaft openings 55*a-b"* configured to receive the shafts of corresponding screwdrivers. The inner panel 56" defines a plurality of shaft openings 57*a-k"* configured to receive the shafts of corresponding screwdrivers. The inner panel 56" also includes a pair of slots 61" and 63" configured to receive tabs 90" and 128" extending from the top closure 18" and the bottom closure 20".

The top closure 18" generally includes an outer panel 70" joined to the main panel 12" along a fold line 76", an intermediate panel 72" joined to the outer panel 70" along a fold line 78" and an inner panel 74" joined to the intermediate panel 72" along a fold line 80". The top closure of this embodiment also includes retaining flaps 22" and 24" joined to the outer panel 70" along fold lines 82" and 84". The outer panel 70" of the top closure 18" defines an elongated slot 86" configured to receive a hanging tab 88". The inner panel 74" includes a pair of tabs 89" and 90" that extend from opposite ends to extend into corresponding slots 39" and 61" in the inner panels 36" and 56" of the left and right support rails 14" and 16". The inner panel 74" also defines a central slot 180" configured to receive tabs 170" and 174". The central slot 180" is centrally located, but it can be offset to accommodate a central beam 160" that is offset from the center of the package 10". Each retaining flap 22" and 24" includes an opening 92" and 94" of sufficient size to accommodate the corresponding screwdriver shaft.

The bottom closure 20" generally includes an outer panel 120" joined to the main panel 12" along a fold line 150", an intermediate panel 122" joined to the outer panel 120" along a fold line 152" and an inner panel 124" joined to the intermediate panel 122" along a fold line 154". The retaining flaps 26" and 28" are joined to the outer panel 120" along fold lines 156" and 158". The inner panel 124" includes a pair of tabs 126" and 128". The inner panel 124" also defines a central slot 182" configured to receive tabs 172" and 176". As with central slot 180", central slot 182" can be offset to accommodate a central beam 160" that is offset from the center of the package 10". In this embodiment, the retaining flaps 26" and 28" each define two openings 130*a-d"* of sufficient size to receive the shafts 104 of the two bottom-most screwdrivers S6 and S12.

As noted above, package 10" includes a central beam 160" that provides supplemental support. In this embodiment, the central beam 160" is formed by additional panels extending from the left support rail 14" and the right support rail 16". Referring now to FIG. 13, the left support rail 14" includes a bridge panel 162" joined to the inner panel 36"

along fold line 190" and an beam panel 164" joined to the bridge panel 162" along fold line 192". The beam panel 164" includes tabs 170" and 172" extending from opposite ends to interfit with slots 180" and 182". The beam panel 164" defines a plurality of shaft openings 194*a-j*" configured to receive the shafts of corresponding screwdrivers. Similarly, the right support rail 16" includes a bridge panel 166" joined to the inner panel 56" along a fold line 196" and a beam panel 168" joined to the bridge panel 166" along a fold line 198". The beam panel 168" includes tabs 174" and 176" extending from opposite ends to interfit with slots 180" and 182". The beam panel 168" defines a plurality of shaft openings 200*a-j*" configured to receive the shafts of corresponding screwdrivers.

As noted above, these alternative embodiments are merely exemplary. The present invention may be incorporated into a wide range of packages intended for packaging a wide range of articles.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A package comprising:

a main panel;

a first support rail extending along a first edge of said main panel, said first support rail defining at least one article support opening;

a second support rail extending along a second edge of said main panel, said second support rail defining at least one article support opening, said first support rail and said second support rail being spaced apart from one another on opposed sides of said main panel;

a first closure extending between said first support rail and said second support rail, said first closure including a first retaining flap and a second retaining flap, said first retaining flap having at least one article support opening configured to be intersecured with said first support rail by an article extending through said article support opening of said first retaining flap and said article support opening of said first support rail, said second retaining flap having at least one article support opening configured to be intersecured with said second support rail by an article extending through said article support opening of said second retaining flap and said article support opening of said second support rail.

2. The package of claim 1 wherein said first closure includes a hanging tab.

3. The package of claim 2 wherein said first closure defines a hanging tab slot and said hanging tab is fitted through said hanging tab slot.

4. The package of claim 3 wherein said first support rail includes an inner panel and an outer panel, said outer panel of said first support rail defines a quillon opening configured to closely receive a quillon of a packaged screwdriver.

5. The package of claim 4 wherein said second support rail includes an inner panel and an outer panel, said outer panel of said second support rail defines a quillon opening configured to closely receive a quillon of a packaged screwdriver.

6. The package of claim 1 wherein said first closure includes an outer panel, an intermediate panel and an inner panel, said first retaining flap and said second retaining flap extending from opposite ends of said outer panel.

7. The package of claim 6 wherein said outer panel extends substantially perpendicularly from said main panel.

8. The package of claim 7 wherein said first support rail defines first and second article openings and said second support rail defines first and second article opening; and further including a second closure extending from said main panel opposite said first closure, said second closure having a first retaining flap and a second retaining flap, said first retaining flap of said second closure having at least one article support opening configured to be intersecured with said first support rail by an article extending through said article support opening of said first retaining flap and said second article support opening of said first support rail, said second retaining flap of said second closure having at least one article support opening configured to be intersecured with said second support rail by an article extending through said article support opening of said second retaining flap and said second article support opening of said second support rail.

9. The package of claim 5 wherein said inner panel of said top closure includes a pair of opposed tabs, said tabs being fitted into corresponding slots in said first support rail and said second support rail.

10. The package of claim 5 further comprising a central beam disposed between said first support rail and said second support rail.

11. The package of claim 10 wherein said central beam is formed by a first beam panel joined to said first support rail and a second beam panel joined to said second panel.

12. The package of claim 11 wherein said first beam panel is joined to said first support rail by a first bridge panel joined to said inner panel of said first support rail, said second beam panel joined to said second support rail by a second bridge panel joined to said inner panel of said second support rail.

13. The package of claim 12 wherein said central beam is interfitted with said inner panel of said first closure to assist in securing said central beam and said inner panel of said first closure in a desire position.

14. A package comprising:

a main panel having a top edge, a bottom edge, a right edge and a left edge;

a left support rail extending from said left edge, said left support rail including an inner panel and an outer panel;

a right support rail extending from said right edge, said right support rail including an inner panel and an outer panel;

a top closure extending from said top edge, said top closure including a left retaining flap disposed between said left support rail inner panel and said left support rail outer panel, said top closure including a right retaining flap disposed between said right support rail inner panel and said right support rail outer panel, wherein said left retaining flap is secured to said left support rail outer panel and said left support rail inner panel by a packaged article, and said right retaining flap is secured to said right support rail outer panel and said right support rail inner panel by a packaged article; and a hanging tab extending from said top closure to allow the package to be suspended from a hanging hook at a point of sale.

15. The package of claim 14 wherein said top closure includes an inner panel and an outer panel, said retaining flaps extending from said outer panel.

16. The package of claim 15 wherein said inner panel of said top closure is fitted between said right support rail and said left support rail.

17. The package of claim 16 wherein said inner panel of said top closure includes a pair of tabs fitted into corresponding slots in said left support rail and said right support rail.

18. The package of claim 17 further including a bottom closure extending from said bottom edge of said main panel, said bottom closure including a left retaining flap disposed between said left support rail inner panel and said left support rail outer panel, said bottom closure including a right retaining flap disposed between said right support rail inner panel and said right support rail outer panel, wherein said left retaining flap of said bottom closure is secured to said left support rail outer panel and said left support rail inner panel by a packaged article, and said right retaining flap of said bottom closure is secured to said right support rail outer panel and said right support rail inner panel by a packaged article.

19. A package comprising:

a main panel a first edge, a second edge opposite said first edge, a third edge intermediate to said first edge and said second edge;

a first support rail extending from said first edge, said first support rail including an inner panel and an outer panel, said first support rail inner panel defining an article opening, said first support rail outer panel defining an article opening;

a second support rail extending from said second edge, said second support rail including an inner panel and an outer panel, said second support rail inner panel defining an article opening, said second support rail outer panel defining an article opening; and a closure extending from said third edge between said first support rail and said second support rail, said closure including a first retaining flap disposed between said first support rail inner panel and said first support rail outer panel, said first retaining flap defining an article opening, said closure including a second retaining flap disposed between said second support rail inner panel and said second support rail outer panel, said second retaining flap defining an article opening, whereby said first retaining flap can be secured to said first support rail by a packaged article extending through said article openings of said first support rail outer panel, said first retaining flap and said first support rail inner panel, and said second retaining flap can be secured to said second support rail by a packaged article extending through said article openings of said second support rail outer panel, said second retaining flap and said second support rail inner panel.

20. The package of claim 19 wherein said first closure includes an outer panel extending substantially perpendicularly to said main panel; and further including a hanging tab extending from said outer panel of said top closure to allow the package to be suspended from a hanging hook at a point of sale.

21. The package of claim 19 wherein said first closure include an outer panel joined to said main panel, an intermediate panel joined to said outer panel and an inner panel joined to said intermediate panel.

22. The package of claim 21 wherein said first support rail further includes an intermediate panel joining said first support rail inner panel to said first support rail outer panel.

23. The package of claim 22 wherein said second support rail further includes an intermediate panel joining said second support rail inner panel to said second support rail outer panel.

24. The package of claim 23 further including a hanging tab extending from said first closure.

25. The package of claim 24 wherein said hanging tab is affixed to said outer panel of said first closure.

26. The package of claim 25 wherein said main panel includes a fourth edge; and further including a second closure extending from said fourth edge between said first support rail and said second support rail, said second closure including a first retaining flap disposed between said first support rail inner panel and said first support rail outer panel, said first retaining flap defining an article opening, said second closure including a second retaining flap disposed between said second support rail inner panel and said second support rail outer panel, said second retaining flap defining an article opening.

27. The package of claim 26 further including a central beam, said central beam including a bridge panel extending from said first support rail and a beam panel extending from said bridge panel.

* * * * *